US006343700B1

(12) United States Patent
Slendebroek et al.

(10) Patent No.: US 6,343,700 B1
(45) Date of Patent: Feb. 5, 2002

(54) TOOTHBRUSH HOLDER

(76) Inventors: Martin J. Slendebroek; Michelle Slendebroek, both of 2596 Scotch Pinte Ct., Grand Rapids, MI (US) 49546

( * ) Notice: Subject to any disclaimer, the term of this patent is extended or adjusted under 35 U.S.C. 154(b) by 0 days.

(21) Appl. No.: 09/246,048

(22) Filed: Feb. 5, 1999

(51) Int. Cl.[7] ..... A47B 81/02; B65D 83/10
(52) U.S. Cl. ..... 211/65; D6/528; 206/362.3
(58) Field of Search ..... 211/65, 66; D6/528; 248/111; 312/206; 206/362.3

(56) References Cited

U.S. PATENT DOCUMENTS

| | | | | | |
|---|---|---|---|---|---|
| 200,083 | A | | 2/1878 | Oviatt | |
| 323,425 | A | | 8/1885 | Johnson | |
| 1,057,541 | A | | 4/1913 | Gettins | |
| 1,212,335 | A | * | 1/1917 | Feinberg | 206/209.1 |
| 1,465,642 | A | * | 8/1923 | Keene | 248/111 |
| D65,892 | S | | 11/1924 | Baker | |
| D66,317 | S | | 12/1924 | Baker | D6/574 |
| 1,560,101 | A | | 11/1925 | Ritter | |
| 1,586,332 | A | * | 5/1926 | Scott | 206/209.1 |
| 2,359,797 | A | | 10/1944 | Schnider | 45/28 |
| D148,431 | S | | 1/1948 | Lund | D86/10 |
| 2,440,385 | A | * | 4/1948 | Schulte | 211/65 |
| D150,133 | S | | 7/1948 | Greenawald | D4/3 |
| D162,282 | S | | 3/1951 | Boulter | D4/3 |
| 2,667,395 | A | * | 1/1954 | Ushanoff | 312/206 |
| 2,715,478 | A | | 8/1955 | Anderson | 220/90 |
| 2,748,977 | A | | 6/1956 | Sarchet | 220/90 |
| 2,808,960 | A | | 10/1957 | Wilson | 220/85 |
| 2,937,910 | A | | 5/1960 | Randa | 312/207 |
| 2,942,925 | A | | 6/1960 | Behling | 312/207 |
| 2,950,946 | A | | 8/1960 | Starworth | 312/207 |
| 2,957,584 | A | | 10/1960 | Jenkins | 211/65 |
| 3,124,399 | A | * | 3/1964 | Seta | 312/206 |
| 3,164,427 | A | | 1/1965 | Norman | 312/209 |
| 3,207,321 | A | | 9/1965 | Joyce | 211/126 |
| 3,321,117 | A | | 5/1967 | Hedin | 223/107 |
| 3,367,610 | A | | 2/1968 | Lindquist | 248/110 |
| D250,305 | S | | 11/1978 | Primiano | D6/86 |
| 4,214,657 | A | * | 7/1980 | Winston | 206/209.1 |
| 4,396,238 | A | * | 8/1983 | Torruella | 312/206 |
| 4,401,215 | A | | 8/1983 | Kramer | 206/362.3 |
| D280,581 | S | | 9/1985 | Altadonna | D6/528 |
| D281,477 | S | | 11/1985 | Neff | D6/574 |
| 4,552,272 | A | | 11/1985 | Field | 211/88 |
| 4,561,556 | A | | 12/1985 | Bendix | 220/90 |
| 4,585,199 | A | * | 4/1986 | Chap | 248/359 |

(List continued on next page.)

FOREIGN PATENT DOCUMENTS

| | | | |
|---|---|---|---|
| DE | 239450 | 10/1911 | |
| DE | 1197741 | 7/1965 | |
| DE | 2706065 | 8/1978 | 206/362.2 |
| FR | 1355500 | 6/1964 | 211/65 |
| GB | 20051 | 11/1892 | |
| SE | 223916 | 10/1942 | |
| SE | 269758 | 11/1950 | |

*Primary Examiner*—Daniel P. Stodola
*Assistant Examiner*—Khoa Tran
(74) *Attorney, Agent, or Firm*—Van Dyke, Gardner, Linn & Burkhart, LLP

(57) ABSTRACT

A toothbrush holder includes a rectangular tray having opposing sides, opposing ends, and a bottom. The distance between the sides of the toothbrush holder are dimensioned to prevent placement of the toothbrush on its side, and thus, prevents potentially contaminating contact between the bristles of the toothbrush and the interior of the toothbrush holder. The length of the toothbrush holder is less than the length of the toothbrush so that a portion of the toothbrush shaft extends beyond the toothbrush holder, enabling facile removal of the toothbrush. The toothbrush holder is preferably attached in a horizontal orientation to a vertical surface to promote effective space utilization. A plurality of toothbrush holders may be secured to one another in a juxtaposed arrangement to thereby permit the support of a plurality of toothbrushes.

28 Claims, 4 Drawing Sheets

U.S. PATENT DOCUMENTS

| | | | | | |
|---|---|---|---|---|---|
| 4,592,604 | A | * | 6/1986 | Wilke | 312/245 |
| D301,292 | S | | 5/1989 | Morris | D6/528 |
| D306,944 | S | | 4/1990 | Urena | D6/513 |
| 5,005,924 | A | | 4/1991 | Haws | 312/237 |
| 5,037,165 | A | | 8/1991 | Rapp et al. | 312/330.1 |
| 5,156,450 | A | | 10/1992 | Lee | 312/248 |
| 5,259,519 | A | | 11/1993 | Lieberman | 211/66 |
| 5,297,677 | A | | 3/1994 | Burian et al. | 206/362.4 |
| 5,382,009 | A | | 1/1995 | Mertz et al. | 269/16 |
| 5,486,044 | A | | 1/1996 | Bennett | 312/312.5 |
| 5,505,301 | A | * | 4/1996 | Foley | 206/362.2 |
| 5,626,407 | A | | 5/1997 | Westcott | 312/405 |
| 5,657,954 | A | * | 8/1997 | Emery et al. | 248/221.12 |
| D396,768 | S | * | 8/1998 | Drake | D6/534 |
| 5,924,567 | A | * | 7/1999 | Wenum | 206/362.3 |

* cited by examiner

TOOTHBRUSH HOLDER

BACKGROUND OF THE INVENTION

This invention relates generally to toiletry items and, in particular, to a toothbrush holder configured to support a toothbrush from a vertical surface.

The effective and sanitary storage of toothbrushes is an ongoing problem faced by almost every household, especially those having children. In the absence of a better means of storage, many people place toothbrushes upon the cabinet surface surrounding a backroom sink. The placement of one or more toothbrushes on the bathroom sink cabinet is an unacceptable solution to the problem for several reasons. This method of storage is unsanitary because such toothbrushes are usually positioned in proximity to the sink where they become susceptible to germs and contamination cause by persons washing their hands and face. Furthermore, the probability for contamination by germs and bacteria is heightened when the toothbrush is placed on its side such that the bristles contact the surface of the cabinet. Additionally, placing toothbrushes on the cabinet sink results in an unsightly appearance, increases clutter, and reduces the amount of space available for other toiletry items.

As an alternative to laying the toothbrush on the cabinet surface, many persons store the toothbrush or toothbrushes in one of the cabinet drawers attached to the sink. This solution is equally unacceptable because the toothbrushes almost invariably contact other items within the drawer, resulting in the potential for contamination. Additionally, placement of one or more toothbrushes within a drawer reduces its capacity to store other items. Also, retrieval of the toothbrush is often difficult because of its tendency to move when the drawer is opened or closed.

In light of these problems, the prior art has advanced several holders for toothbrushes. Most commonly, these toothbrush holders are upright containers placed upon the surface of the cabinet. The holders are formed with one or more holes into which the shaft of the toothbrush is placed to thereby hold the same in an upright vertical position. Although these holders are usually successful in preventing the placement of toothbrushes upon the cabinet surface, such holders do not prevent the possibility of contamination. Often, these containers are place in proximity to the sink, and consequently are contaminated by bath water when one uses the sink. Furthermore, when in the secured position, the toothbrush depends within the container while the head of the Toothbrush, carrying the bristles, is exposed. As a result, individuals have a tendency to grasp the bristles when removing the toothbrush from the container, thereby increasing the risk of placing germs and bacteria upon the bristles themselves. Furthermore, these holders have a tendency to utilize a great deal of cabinet surface space, especially when the household contains several persons.

Consequently, there exists a need for a toothbrush holder which is easily and economically manufactured, supports a toothbrush in a sanitary manner, and maximizes space utilization.

SUMMARY OF THE INVENTION

Accordingly, the present invention provides a toothbrush holder comprised of rectangular tray having a pair of opposing sides, a pair of opposing ends, and a bottom. One side of the toothbrush holder is configured for attachment to a vertical surface such as the wall adjacent to the bathroom sink, or the interior sidewall of a drawer. When secured, the toothbrush holder assumes a horizontal orientation, and permits one to support a toothbrush in an elevated position from either the cabinet surface or the bottom of a drawer. This features effectively eliminates contamination of the toothbrush caused by contact with bath water or other items placed in proximity to the toothbrush. Furthermore, elevating the toothbrush holder from a surface enables that surface to be used in the support and storage of other items.

According to another aspect of the invention, the toothbrush holder is formed such that the distance between the interior surfaces of the sides is slightly larger than the head of the toothbrush while smaller than the bristles attached to the toothbrush head. Consequently, in the event one attempts to place the toothbrush on its side, an edge of the toothbrush head will contact one of the sides of the toothbrush holder, and thereby provides a disincentive to improperly placing the toothbrush within the toothbrush holder. This feature assures that the bristles remain in the upright position, and thereby avoids contamination of the toothbrush by prohibiting contact between the bristles and the interior of the toothbrush holder. Furthermore, when the toothbrush holder is attached to the sidewall of a drawer, the close fit between the head of the toothbrush and the sides prevents movement and tipping of the toothbrush when the drawer is retracted or extended.

According to another aspect of the invention, the distance between opposing ends of the toothbrush holder is such that a portion of the shaft of the toothbrush extends beyond an end of the toothbrush holder when in the secured position. Consequently, one can easily grasp the shaft of the toothbrush, enabling facile extraction of the toothbrush from the toothbrush holder via the shaft. Furthermore, enabling one to grasp the end of the toothbrush shaft prevents one from attempting to extract the toothbrush by grasping the bristles and thereby minimizes the potential for contamination.

In a preferred embodiment, the toothbrush holder is attached to a vertical surface by a strip of double-sided tape. In an alternative preferred embodiment, one or more screws extend horizontally from the vertical surface, while a side of the toothbrush holder is formed with one or more apertures, each of which is dimensioned to receive a screw. Also, preferably, the side of the toothbrush holder is formed with one or more laterally positioned slots in communication with each aperture. When the screw is positioned through an aperture, the toothbrush holder may be slideably moved to cause frictional engagement between the shaft of the screw and the slot to thereby hold the toothbrush holder securely in place. Attachment of the toothbrush holder to a vertical surface using screws and complimentary apertures enables one to easily remove the toothbrush holder from the vertical surface in order to clean the toothbrush holder.

According to another aspect of the invention, a toothbrush holder assembly is advanced having two or more individual toothbrush holders attached in a juxtaposed arrangement. Specifically, attachment between adjacent toothbrush holders is achieved by the use of a strip of double-sided tape, or like adhesive. The modular feature of the present invention enables one to conveniently add additional toothbrush holders when circumstances require the storage of additional toothbrushes.

The present invention advances an effective, economical toothbrush holder which minimizes contact between the toothbrush and other items and, hence, minimizes contamination, while also providing ease of access, grasping and storage of the toothbrush. Furthermore, attachment of the toothbrush holder to a vertical surface conserves cabinet or drawer space, while the modularity of the toothbrush holder permits the storage of additional toothbrushes.

These and other objects, advantages, and features of this invention will become apparent upon review of the follow specification in conjunction with the drawings.

DETAILED DESCRIPTION OF THE PREFERRED EMBODIMENTS

The present invention advances a toothbrush holder which sanitarily supports a toothbrush in an elevated position from a vertical surface. The toothbrush holder is economical to manufacture and can be made in a variety of sizes to accommodate differing toothbrush dimensions. Furthermore, the toothbrush holder may be manufactured with a variety of aesthetic designs to increase a child's attention and thereby promote effective dental hygiene.

Figure 1:
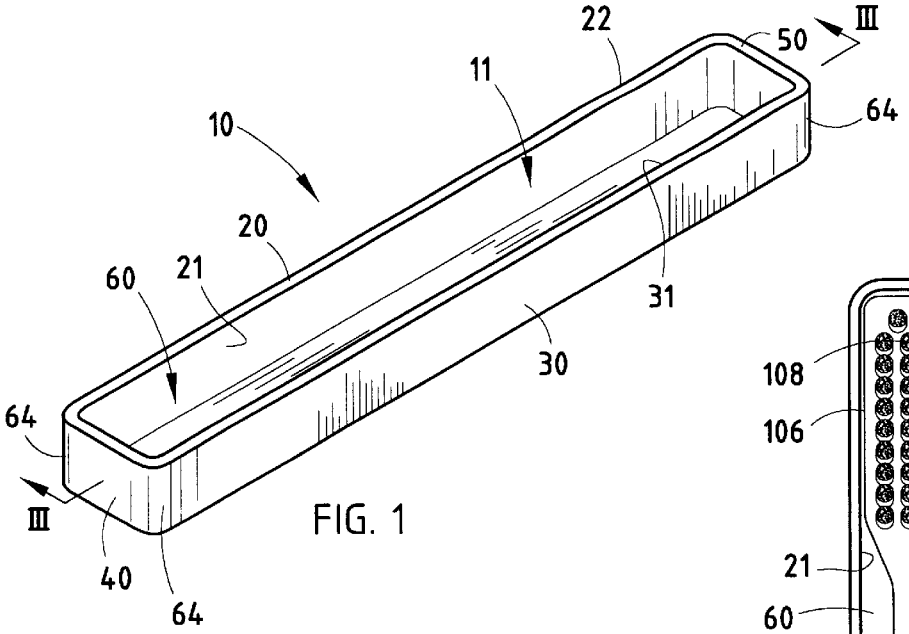
FIG. 1 is a perspective view of a toothbrush holder according to the present invention.
Figure 2:
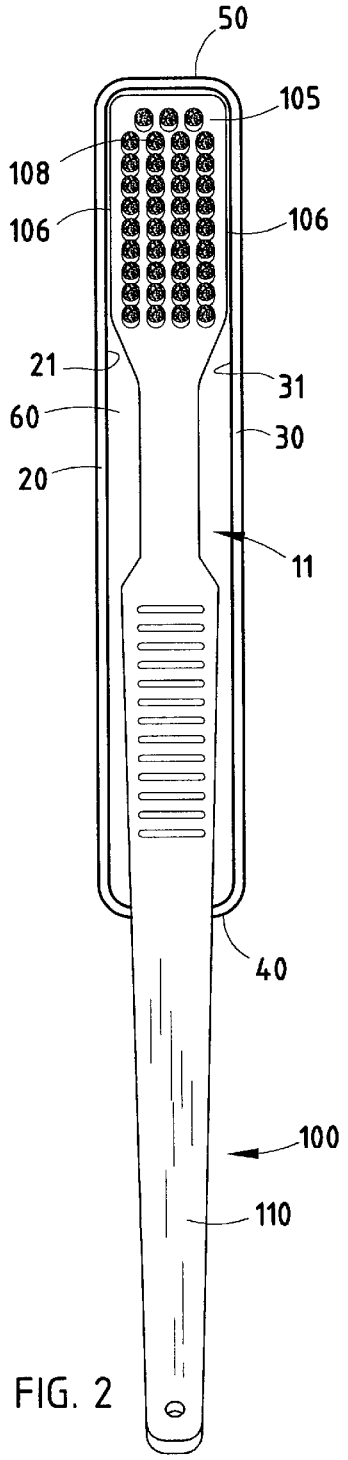
FIG. 2 is a top view of the toothbrush holder of FIG. 1 illustrated with a toothbrush positioned therein.
Figure 3:
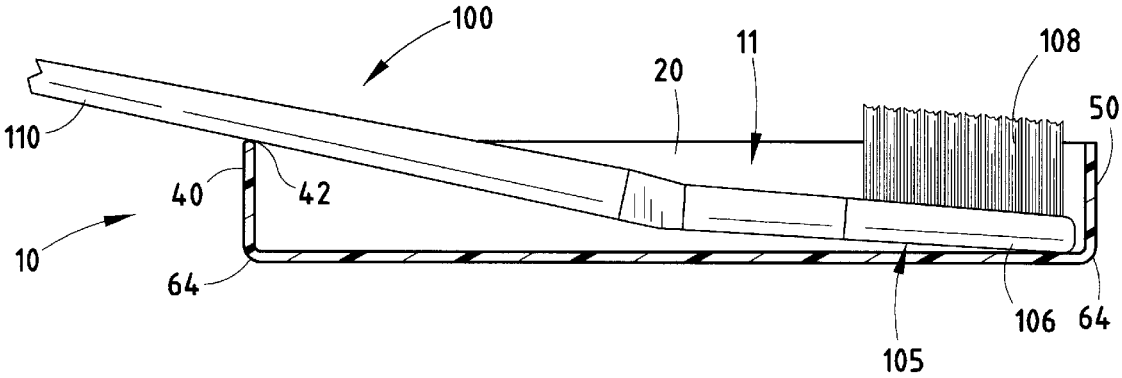
FIG. 3 is a cross-sectional side view of the toothbrush holder of FIG. I taken along line III—III, illustrated with a toothbrush positioned therein.
Figure 4:
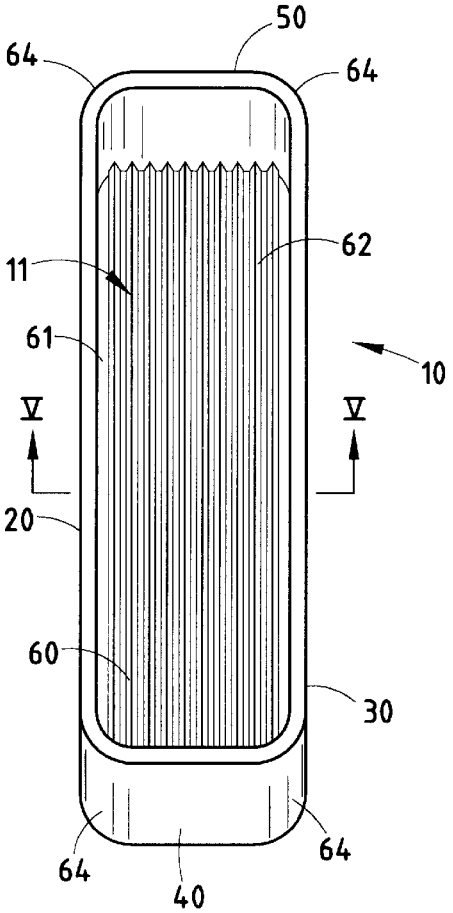
FIG. 4 is a top perspective view of a toothbrush holder according to an alternative preferred embodiment of the invention.
Figure 5:
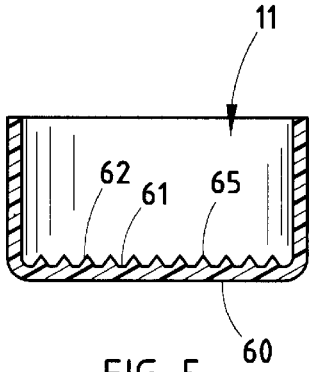
FIG. 5 is a side, cross sectional view of the toothbrush holder of FIG. 4 taken long line V—V of FIG. 4.

Referring now to FIGS. 1–3, and the illustrative embodiment depicted therein, a toothbrush holder 10 comprises a preferably generally rigid, rectangular tray having, a pair of opposing sides 20 attached to 30, and a pair of opposing ends 40 and 50. Attached to the bottom of sides 20, 30 and ends 40, 50 is a floor or bottom 60. Each of the sides 20, 30, ends 40, 50 and floor or bottom 60 is preferably rigid. Alternatively, holder 10 may be formed from a semi-rigid material which will bend resiliently, yet return to its original shape. Such semi-rigid material should provide enough support to hold a toothbrush in the manner described herein, and be sufficiently strong to allow support of one or more additional toothbrush holders as described herein and shown in FIGS. 8 and 9. Preferably, toothbrush holder 10 is integrally formed in one piece by molding, such as by injection molding, from a durable, watertight material. For example, toothbrush holder 10 may be formed from a resinous polymeric composition such as ABS plastic, nylon, polyethylene, polypropylene or the like. Also, as shown in FIGS. 4 and 5, inner surface 61 of bottom 60 is preferably formed with a series of ribs 62 running parallel to sides 20, 30. Ribs 62 prevent the aggregation or pooling of water upon bottom 60 and thereby aid in the evaporation of water from toothbrush holder 10. Also, when toothbrush 100 is positioned within interior 11, the bottom of toothbrush head 105 will rest upon tops 65 of ribs 62. Thus, any water on toothbrush 100 will be allowed to drain therefrom and enter the interstitial spaces defined between ribs 62.

As illustrated, toothbrush holder 10 has contoured or rounded corners 64 at the intersections between sides 20, 30, ends 40 and 50 and bottom 60. Rounded corners 64 prevent injury caused by sharp surfaces when one is extracting or replacing toothbrush 100 from toothbrush holder 10 or when removing other items from the drawer to which toothbrush holder 10 is secured.

As depicted in FIG. 2, the distance between interior surface 21 of side 20 and interior surface 31 of side 30 is slightly larger than the distance between opposing edges 106 of toothbrush head 105. Consequently, when toothbrush 100 is positioned within interior 11 of toothbrush holder 10, toothbrush head 105 will rest upon bottom 60 with bristles 105 extending upwardly. In the event toothbrush 100 is tipped or an attempt is made to improperly place toothbrush 100 within toothbrush holder 10, an edge 106 of toothbrush head 105 will contact a side 20 or 30 prior to bristles 108 touching a side 20 or 30. The close fit between toothbrush head 105 and interior surfaces 21 and 31 of sides 20 and 30, respectively, assures that bristles 108 assume an upright position, and hence prevents potentially contaminating contact between bristles 108 and side 20 or 30 of toothbrush holder 10. Moreover, this close fit maintains toothbrush 100 within interior 11 of toothbrush holder 10 and prevents displacement of toothbrush 100 in the event of inadvertent contact with shaft 110, or when the drawer to which toothbrush holder 10 is attached is moved from the open to closed position.

As shown most clearly in FIGS. 2 and 3, the distance between end 40 and end 50 of toothbrush holder 10 is less than the length of toothbrush 100. Consequently, when toothbrush 100 is stored within toothbrush holder 10, toothbrush 100 assumes a slightly inclined position with shaft 110 resting upon top edge 42 of end 40 and extending therebeyond. Consequently, when it is desired to remove toothbrush 100 from toothbrush holder 10, one can easily grasp the portion of shaft 110 positioned exterior to toothbrush holder 11. As a result, persons are disinclined to remove toothbrush 100 by grasping bristles 108 which thereby reduces the potential for contamination of toothbrush 100.

Figure 6:
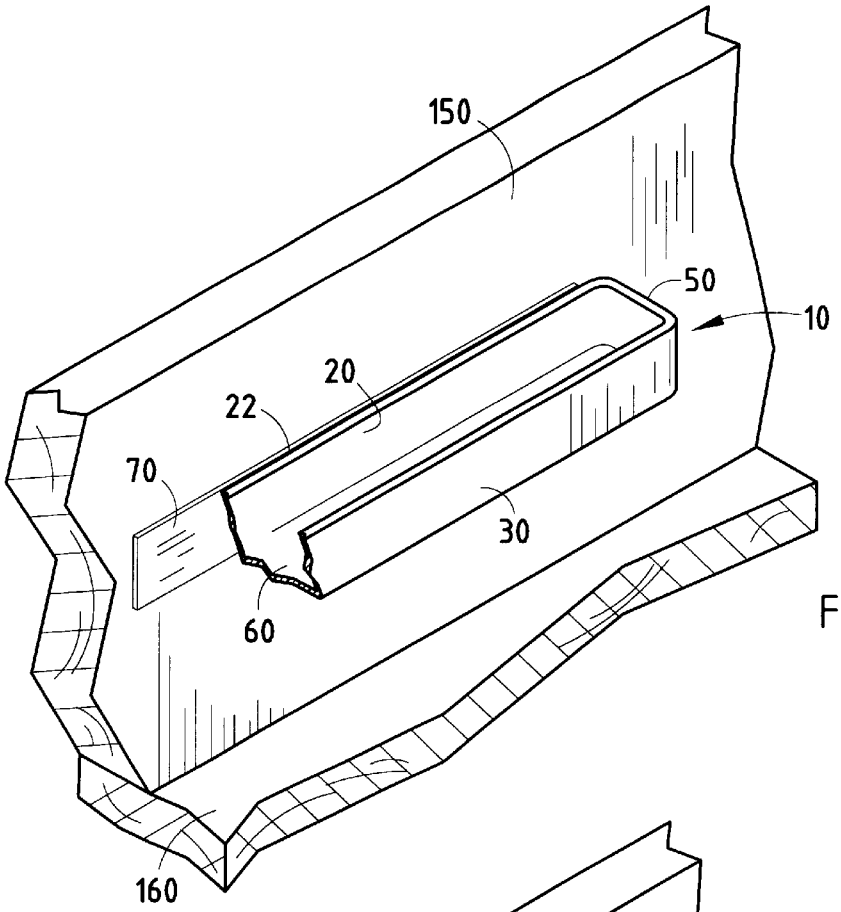
FIG. 6 is a perspective, partial cutaway view depicting the toothbrush holder of FIGS. 1–3 secured to a vertical surface, according to a preferred embodiment of the invention.

Turning now to FIG. 6, according to a preferred embodiment, toothbrush holder 10 is attached to vertical surface 150 so that toothbrush holder 10 assumes a horizontal orientation. Securement of toothbrush holder 10 to vertical surface 150 is achieved by placing an adhesive between exterior surface 22 of side 20 and vertical surface 150. The adhesive used can be any adhesive commonly employed in the art. Preferably, a strip of double-sided tape 70 is used to secure toothbrush holder 10 to vertical surface 150. The height of double-sided tape 70 should be no greater than the height of side 20 so as to avoid contact between the adhesive on double-sided tape 70 and persons using toothbrush holder 10. By way of example, a double-sided tape 70 which may used with the present invention is manufactured by the 3M Corporation and promoted under the trademark SCOTCH.

Preferably, toothbrush holder 10 is positioned a sufficient distance from and above horizontal floor 160 adjacent vertical surface 150 so as to enable placement of items under toothbrush holder 10. It will be recognized by those with ordinary skill in the art that vertical surface 150 may be the sidewall adjacent to a bathroom sink cabinet or the interior surface of a sidewall of a drawer positioned within a bathroom cabinet. It is further recognized that toothbrush holder 10 may be attached to other vertical surfaces without departing from the spirit and scope of the invention.

Figure 7:
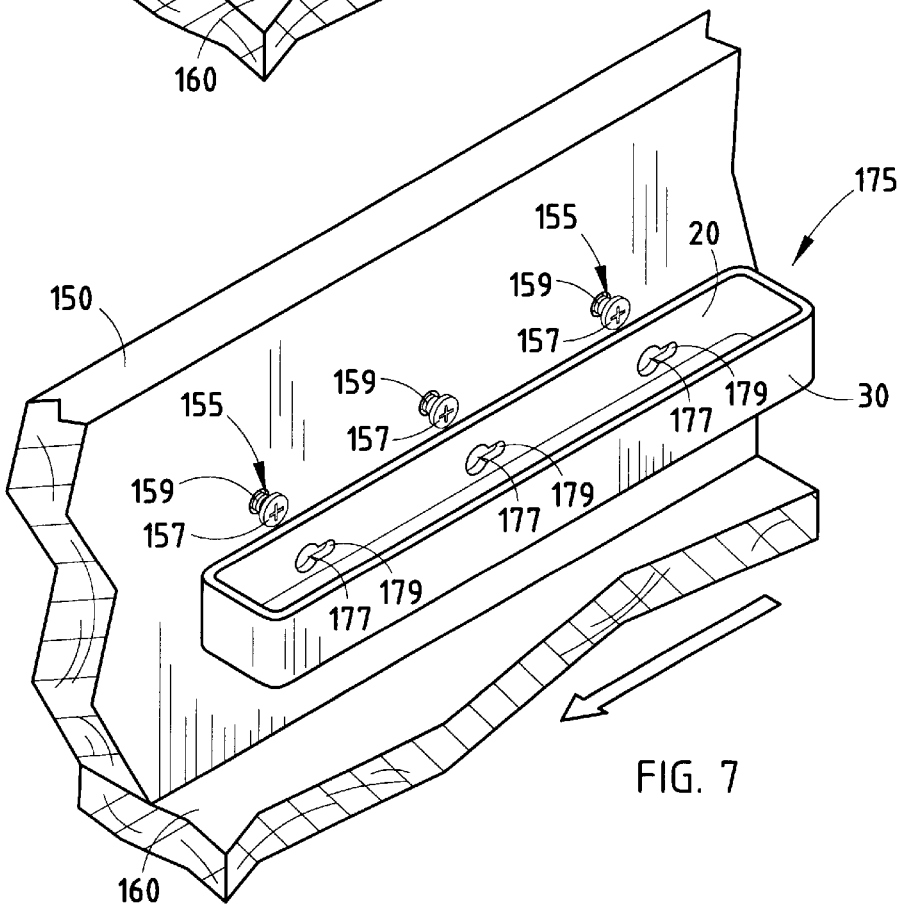
FIG. 7 is a perspective, exploded view depicting the securement of the toothbrush holder of FIGS. 1–3 to a vertical surface, according to an alternative preferred embodiment of the invention.

Referring now to FIG. 7, there is shown a toothbrush holder 175 according to an alternative preferred embodiment. Toothbrush holder 175 is similar in construction to toothbrush holder 10 and therefore, like reference numerals will be used in the description of like elements. In this embodiment, side 20 of toothbrush holder 175 is formed with one or more through holes 177. Each throughhole 177 is in communication with a laterally positioned slot 179. To secure toothbrush holder 175 to vertical surface 10, one or more screws 155 are driven into vertical surface 150 and project a preselected distance therefrom. Each screw 155 is composed of a head 157 attached to a shaft 159. Heads 157 are each slightly smaller than throughholes 177. Once screws 155 are positioned within vertical surface 150, toothbrush holder 175 is moved toward vertical surface 150 so that heads 157 of screws 155 extend through throughholes 177 formed in side 20. Thereafter, toothbrush holder 175 is moved in the direction indicated by the directional arrow of FIG. 7, causing shafts 159 of screws 155 to frictionally engage slots 179 which are only slightly larger than shafts 159 to allow such frictional engagement. Frictional engagement between shafts 159 and slots 179 holds toothbrush holder 175 firmly in place. To disengage toothbrush holder 175 from vertical surface 150, toothbrush holder 175 is moved in a direction opposite to the direction depicted in FIG. 6 to thereby remove shafts 159 from slots 177. Toothbrush holder 175 is then moved in a lateral direction to remove screws 155 from throughholes 177. Attachment of toothbrush holder 175 to vertical surface 150 in this manner enables the facile removal of toothbrush holder 175 from vertical surface 150 to permit one to clean toothbrush holder 175.

Figure 8:
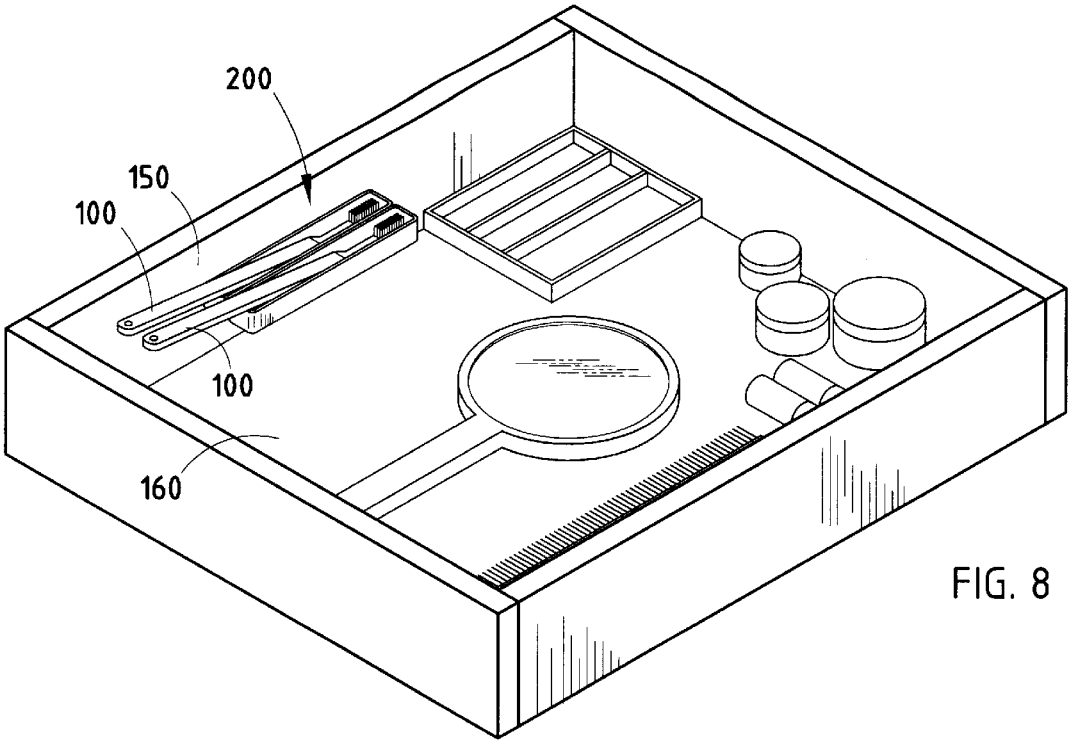
FIG. 8 is a perspective view depicting a toothbrush holder assembly according to the present invention illustrated secured to the sidewall of a drawer.
Figure 9:
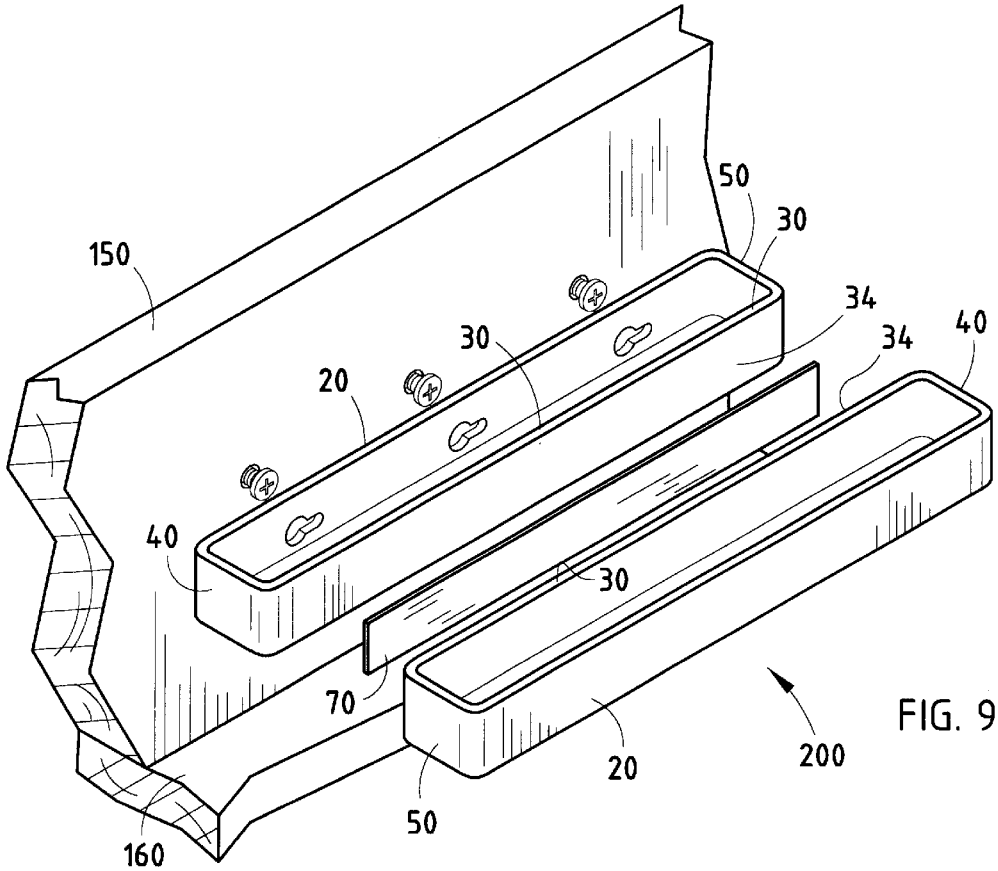
FIG. 9 is an exploded, perspective view of the toothbrush holder assembly depicted in FIG. 8.

Turning now to FIGS. 8 and 9, there is shown another toothbrush holder assembly according to the present invention and designated generally by reference numeral 200. Toothbrush holder assembly 200 is comprised of two or more individual toothbrush holders 10 or 175 positioned in a juxtaposed arrangement. As shown in FIG. 9, the toothbrush holder attached to vertical surface 150 is depicted as being toothbrush holder 175 illustrated in FIG. 6. However, it will be recognized by those with ordinary skill in the art that the toothbrush holder which is attached to vertical surface 150 may be toothbrush holder 10, depicted in FIGS. 1 through 6, without departing from the spirit and scope of the invention. Attachment between the individual toothbrush holders which comprise toothbrush holder assembly 200 is achieved by double-sided tape 70 which is positioned on exterior surfaces 34 of sides 30 of adjacent toothbrush holders. It is also recognized by those with ordinary skill in the art that although depicted as having only two toothbrush holders, toothbrush holder assembly 200 may be equipped with more than two toothbrush holders without departing from the spirit and scope of the present invention.

The above description is considered that of the preferred embodiments only. Modifications of the invention will occur to those skilled in the art and to those who make or use the invention. Therefore, it is understood that the embodiments shown in the drawings and described above are merely for illustrative purposes and are not intended to limit the scope of the invention, which is defined by the following claims as interpreted according to the principles of patent law, including the doctrine of equivalents.

The embodiments of the invention in which an exclusive property or privilege is claimed are as follows:

1. A toothbrush holder assembly for attachment to a vertical surface said toothbrush holder assembly comprising:

a toothbrush having a length and a head attached to a shaft, said head having bristles extending therefrom, and a toothbrush holder including:

a pair of opposing sides, each side of said pair of opposing sides having an interior surface, wherein said pair of opposing sides are of equal length, and wherein one side of said pair of opposing sides is attached to the vertical surface in a horizontal orientation, and a bottom extending between said pair of opposing sides, said pair of opposing sides and said bottom defining an interior said bottom having an interior surface and a plurality of ribs extending from said interior surface, said plurality of ribs formed along the entire length of said interior surface of said bottom, wherein the length of said bottom is less than the length of said toothbrush, wherein said pair of opposing sides are spaced such that the bristles of said toothbrush are prohibited from contacting an interior surface of a side of said pair of opposing sides when an edge of said head of said toothbrush is in contact with a side of said pair of opposing sides and the opposing edge of said head of said toothbrush is in contact with said bottom, wherein at least a section of said shaft projects outside said interior.

2. The toothbrush holder assembly as recited in claim 1, wherein said toothbrush holder is attached to a vertical surface having at least one screw projecting therefrom and wherein said pair of opposing sides is a first side and a second side, said first side fox-ed with at least one throughhole, said throughhole dimensioned to receive said at least one screw projecting from the vertical surface.

3. The toothbrush holder assembly as recited in claim 2, wherein the at least one screw has a shaft and a head, and wherein said first side is formed with a throughhole and a slot, said slot being in communication with said throughhole, wherein the head of the at least one screw is dimensioned to pass through said throughhole, and wherein said slot is dimensioned to frictionally engage the shaft of the at least one screw.

4. The toothbrush holder assembly as recited in claim 1, further comprising a first end and an opposing second end, said first end and said second end attached to said first side and said opposing second side.

5. The toothbrush holder assembly as recited in claim 1, wherein said pair of opposing sides further comprises a first side and a second side, said first side having an exterior surface, wherein said exterior surface of said first side is attached to a vertical surface by an adhesive.

6. The toothbrush holder assembly as recited in claim 1, wherein said pair of opposing sides further comprises a first side and a second side, said first side having an exterior surface, and wherein said exterior surface of said first side is attached to a vertical surface by a strip of double-sided tape.

7. The toothbrush holder assembly as recited in claim 1, wherein said pair of opposing sides are integrally attached to said bottom.

8. The toothbrush holder assembly as recited in claim 1, wherein said toothbrush holder is formed of a polymeric material.

9. A toothbrush holder assembly comprising:

at least one toothbrush having a head attached to a shaft, said head having bristles extending therefrom;

a first toothbrush holder having a bottom, an interior and an open top, said bottom having an interior surface formed with a plurality of ribs extending therefrom, said plurality of ribs formed along the entire length of said interior surface of said bottom, said interior dimensioned to removably support said at least one toothbrush, said first toothbrush holder having at least one end having a top edge, wherein when said at least one toothbrush is received by said first toothbrush holder, said shaft of said at least one toothbrush rests upon said top edge of said end of said first toothbrush holder when said head of said at least one toothbrush is positioned within said interior, and at least a section of said head of said at least one toothbrush is supported by said interior surface of said bottom, and said bristles extend in a direction away from said bottom, said first toothbrush holder having a first side and an opposing second side of equal length, said first side of said first toothbrush holder secured to a vertical surface in a substantially horizontal position; and a second toothbrush holder having a bottom, an interior and an open top, said bottom having an interior surface formed with a plurality of ribs extending therefrom, said plurality of ribs formed along the entire length of said interior surface of said bottom, said interior dimensioned to removably support said at least one toothbrush, said second toothbrush holder having at least one end having a top edge, wherein when said at least one toothbrush is received by said second toothbrush holder, said shaft of said at least one toothbrush rests upon said top edge of said end of said second toothbrush holder when said head of said at least one toothbrush is positioned within said interior and at least a section of said head of said at least one toothbrush is supported by said interior surface of said bottom, and said bristles extend in a direction away from said bottom, said second toothbrush holder having a first side and an opposing second side of equal length, wherein said second side of said first toothbrush holder is secured to said first side of said second toothbrush holder in a substantially horizontal position.

10. The toothbrush holder assembly as recited in claim 9, wherein said first side of said second toothbrush holder and said second side of said second toothbrush holder each have an inner surface, wherein said first side and said second side of said second toothbrush holder are spaced such that when said at least one toothbrush is received by said second toothbrush holder, said bristles of said at least one toothbrush are prohibited from contacting said inner surface of said first side when an edge of said head of said at least one toothbrush is in contact with said second side and the opposing edge of said head of said at least one toothbrush is in contact with said bottom.

11. The toothbrush holder assembly as recited in claim 10, wherein when said at least one toothbrush is received by said second toothbrush holder, the length of said bottom of said second toothbrush holder is less than the length of said at least one toothbrush.

12. The toothbrush holder assembly as recited in claim 9, wherein said first side of said first toothbrush holder and said second side of said first toothbrush holder each have an inner surface, wherein said first side and said second side of said first toothbrush holder are spaced such that, when said at least one toothbrush is received by said first toothbrush holder, said bristles of said at least one toothbrush are prohibited from contacting said inner surface of said first side when an edge of said head of said at least one toothbrush is in contact with said second side and the opposing edge of said head of said at least one toothbrush is in contact with said bottom.

13. The toothbrush holder assembly as recited in claim 12, wherein when said at least one toothbrush is received by said first toothbrush holder, the length of said bottom of said first toothbrush holder is less than the length of said at least one toothbrush.

14. The toothbrush holder assembly as recited in claim 9, wherein said at least one end of said first toothbrush holder is a first end and a second end, and wherein said second end is positioned at a distance from said first end less than the length of said at least one toothbrush such that said shaft will rest on the upper edge of said second end when said at least one toothbrush is received in said first toothbrush holder.

15. The toothbrush holder assembly as recited in claim 9, wherein said at least one end of said second toothbrush holder is a first end and a second end and, wherein said second end is positioned at a distance from said first end less than the length of said at least one toothbrush such that said shaft will rest on the upper edge of said second end when said at least one toothbrush is received in said second toothbrush holder.

16. The toothbrush holder assembly as recited in claim 9, wherein said first toothbrush holder is attached to said second toothbrush holder by an adhesive.

17. The toothbrush holder assembly as recited in claim 9, wherein said first toothbrush holder is attached to said second toothbrush holder by a strip of double sided tape.

18. The toothbrush holder assembly as recited in claim 9, wherein said first of said first toothbrush holder is formed with at least one throughhole for receiving a fastener therethrough.

19. The toothbrush holder assembly as recited in claim 9, wherein said first side of said first toothbrush holder is formed with a throughhole and a slot, said slot being in communication with said throughhole, said slot and throughhole adapted for receiving a fastener therethrough.

20. The toothbrush holder assembly as recited in claim 9, wherein said first toothbrush holder includes a strip of double-sided tape attached to said first side.

21. A toothbrush holder assembly comprising:

toothbrush having a head attached to a shaft, said head having bristles extending therefrom; and a toothbrush holder including:

a pair of opposing sides, one side of said pair of opposing sides attached to a vertical surface, wherein said pair of opposing sides are of equal length and are substantially linear, a pair of opposing ends, said pair of opposing ends attached to said pair of opposing sides, each end of said pair of opposing ends having a top edge, wherein said pair of opposing sides are substantially parallel between said pair of opposing ends, and a bottom attached to said pair of opposing ends and said pair of opposing sides, said bottom having an interior surface formed with a plurality of ribs extending therefrom, said ribs formed along the entire length of said interior surface of said bottom, said opposing sides and said opposing ends defining an interior, wherein said pair of opposing ends define a distance therebetween, wherein when said toothbrush is received by said toothbrush holder, at least a section of said head of said toothbrush is supported by said bottom, with said bristles extending in a direction away from said bottom, said distance between said pair of opposing ends is less than the length of said toothbrush such that said shaft of said toothbrush rests upon a top edge of one end of said pair of opposing ends, and at least a section of said shaft of said toothbrush is positioned within said interior, and at least a section of said shaft of said toothbrush is positioned outside said interior.

22. The toothbrush holder assembly as recited in claim 21, wherein each side of said pair of opposing sides has an inner surface, wherein said pair of opposing sides are spaced such that said bristles of said toothbrush are prohibited from contacting an inner surface of a side of said pair of opposing sides when an edge of said head of said toothbrush is in contact with a side of said pair of opposing sides and the opposing edge of said head of said toothbrush is in contact with said bottom.

23. The toothbrush holder assembly as recited in claim 21, wherein said one side of said pair of opposing sides has an exterior surface, wherein said exterior surface of said one side is attached to the vertical surface by an adhesive.

24. The toothbrush holder assembly as recited in claim 21, wherein said one side of said pair of opposing sides has an exterior surface, and wherein said toothbrush holder further comprises a strip of double sided tape, said strip of double sided tape attached to said exterior surface of said one side and the vertical surface.

25. The toothbrush holder assembly as recited in claim 21, wherein said one side of said pair of opposing sides is formed with at least one throughhole for receiving a fastener therethrough.

26. The toothbrush holder assembly as recited in claims 21, wherein said one side of said pair of opposing sides is formed with a throughhole and a slot, said slot being in communication with said throughhole, said slot and throughhole adapted for receiving a fastener therethrough.

27. The toothbrush holder assembly as recited in claim 21, wherein said toothbrush holder is integrally formed such that said pair of opposing sides, said pair of opposing ends and said bottom are formed in one piece.

28. The toothbrush holder assembly as recited in claim 21, wherein said toothbrush holder is formed of a polymeric material.

* * * * *

UNITED STATES PATENT AND TRADEMARK OFFICE

CERTIFICATE OF CORRECTION

PATENT NO. : 6,343,700 B1
APPLICATION NO. : 09/246048
DATED : February 5, 2002
INVENTOR(S) : Martin J. Slendebroek and Michelle Slendebroek It is certified that error appears in the above-identified patent and that said Letters Patent is hereby corrected as shown below:

Column 1
Line 49, "Toothbrush" should be --toothbrush--.

Column 3
Line 15, "FIG. I" should be --FIG. 1--.
Line 49, Delete "," after "having".
Line 50, "20 attached to 30, and a" should be --20 and 30, attached to a--.

Column 4
Line 45, "11" should be --10--.

Column 5
Line 14, "through holes" should be --throughholes--.

Column 6
Line 9, Claim 1, "," should be --;-- in the second occurrence.
Line 20, Claim 1, Insert --,-- after "interior".
Line 39, Claim 2, "fox-ed" should be --formed--.

Column 8
Line 37, Claim 18, Insert --side-- after "wherein said first".
Line 49, Claim 21, Insert --a-- before "toothbrush".
Line 65, Claim 21, Insert --said bottom,-- after "bottom,".

Signed and Sealed this

Third Day of March, 2009

JOHN DOLL
*Acting Director of the United States Patent and Trademark Office*